US006581309B1

(12) United States Patent
Conforti

(10) Patent No.: US 6,581,309 B1
(45) Date of Patent: Jun. 24, 2003

(54) CLOTHES IRON

(76) Inventor: Carl J. Conforti, P.O. Box 6315, Fall River, MA (US) 02724

( * ) Notice: Subject to any disclaimer, the term of this patent is extended or adjusted under 35 U.S.C. 154(b) by 0 days.

(21) Appl. No.: 10/008,499

(22) Filed: Dec. 7, 2001

(51) Int. Cl.[7] ..... D06F 75/26; D06F 75/38
(52) U.S. Cl. ..... 38/77.7; 38/93
(58) Field of Search ..... 38/77.7, 88, 93; 374/141, 162; 116/205, 207, 216

(56) References Cited

U.S. PATENT DOCUMENTS 3,224,122 A * 12/1965 Jepson et al. ..... 38/77.2
4,347,428 A * 8/1982 Conrad et al. ..... 219/251
4,686,352 A * 8/1987 Nawrot et al. ..... 219/250
5,210,395 A * 5/1993 Freeman ..... 219/250
5,642,578 A * 7/1997 Hazan et al. ..... 38/77.7

* cited by examiner

*Primary Examiner*—Ismael Izaguirre
(74) *Attorney, Agent, or Firm*—Shane H. Hunter, Esq.

(57) ABSTRACT

A temperature indicator for a clothes iron includes a heat-sensitive element configured to be coupled to a clothes iron and configured to be disposed to receive heat from a heating surface of the clothes iron, and a visual indicator coupled to the heat-sensitive element and configured to provide a visual indication of heat received by the heat-sensitive element.

19 Claims, 4 Drawing Sheets

CLOTHES IRON

FIELD OF THE INVENTION

The invention relates to heating instruments and more particularly to clothes irons and more even particularly to indicating temperatures of clothes irons.

BACKGROUND OF THE INVENTION

Many household devices employ heat to achieve their goals. For example, curling irons provide heat for sculpting hair into desired forms, and clothes irons provide a heated flat surface for removing wrinkles from clothes. Both curling irons and clothes irons may have passages for supplying steam to help with the devices' objectives. Other devices exist that also use heat to achieve desired results, but the heat may be of an intensity or level that is hazardous, e.g., that may burn skin if the device is touched on a heated surface. Heating devices often have temperature selectors so that a desired amount of heat can be provided by the device, e.g., so that a clothes iron may be used for cottons versus linens, or may be hot enough to provide steam.

SUMMARY OF THE INVENTION

In general, in an aspect, the invention provides a temperature indicator for a clothes iron. The indicator includes a heat-sensitive element configured to be coupled to a clothes iron and configured to be disposed to receive heat from a heating surface of the clothes iron, and a visual indicator coupled to the heat-sensitive element and configured to provide a visual indication of heat received by the heat-sensitive element.

Implementations of the invention may include one or more of the following features. The heat-sensitive element and the visual indicator comprise a thermochromatic material. The the thermochromatic material is configured to reflect light differently in response to receiving heat from the heating surface of the clothes iron. The thermochromatic material is configured to be substantially opaque at room temperature and substantially transparent in response to receiving heat from the heating surface, the visual indicator further comprising an image disposed beneath the thermochromatic material such that the image is substantially obscured when the thermochromatic material is substantially opaque and is substantially visible through the thermochromatic material when the thermochromatic material is substantially transparent.

Implementations of the invention may also include one or more of the following features. The visual indicator is disposed on at least one of the heating surface of the clothes iron, a side surface of the clothes iron. The visual indicator provides a substantially binary indication of temperature of the heating surface. The visual indicator provides indicia of at least three amounts of temperature of the heating surface.

In general, in another aspect, the invention provides a clothes iron including a grip portion configured to be grasped by a person, a heating surface coupled to the grip portion and configured to provide heat, and a heat-indicative apparatus coupled to the heating surface and configured to provide a visual indication of a temperature of the heating surface.

Implementations of the invention may include one or more of the following features. The heat-indicative apparatus comprises a thermochromatic material. The thermochromatic material is configured to reflect light differently in response to receiving heat from the heating surface of the clothes iron. The thermochromatic material is configured to be substantially opaque at room temperature and substantially transparent in response to receiving heat from the heating surface, the visual indicator further comprising an image disposed beneath the thermochromatic material such that the image is substantially obscured when the thermochromatic material is substantially opaque and is substantially visible through the thermochromatic material when the thermochromatic material is substantially transparent. The thermochromatic material is configured to be different colors when at approximately room temperature versus at a temperature above a predetermined threshold.

Implementations of the invention may also include one or more of the following features. The heat-indicative apparatus comprises at least one visual indicator disposed on at least one of the heating surface of the clothes iron and a side surface of the clothes iron. The heat-indicative apparatus comprises a visual indicator configured to provide a substantially binary indication of temperature of the heating surface. The heat-indicative apparatus comprises a visual indicator configured to provide indicia of at least three amounts of temperature of the heating surface. The indication of temperature is an indication of whether the heating surface is below a temperature at which the heating surface is considered to be safe to touch.

In general, in another aspect, the invention provides a clothes iron including a body including a handle, a base, and a heat-providing surface, and means for indicating a temperature of the heat-providing surface, the means including indicia of the heat-providing surface being at a first temperature considered to be safe to touch and of the heat-providing surface being at a second temperature considered to be unsafe to touch.

Implementations of the invention may include the indicating means including an indication of the heat-providing surface being at a third temperature that is different from the first and second temperatures.

Various aspects of the invention may provide one or more of the following advantages. Indications of temperature of devices and/or surfaces of devices may be provided. Temperature indications may be provided using thermistors, thermochromatic items such as paints, and/or thermocouples. Temperature indications may be provided visually, e.g., on a surface of a heat-providing device such as an iron. Visual temperature indications may be provided on a top of an iron. Temperature indications may indicate safe versus unsafe, and/or grades of temperature, e.g., for different purposes such as ironing different types of clothes or providing steam. Audio indications of temperature may be provided. A grip of a device may be responsive to body heat to solidify while conforming to a user's grip.

These and other advantages of the invention, along with the invention itself, will be more fully understood after a review of the following figures, detailed description, and claims.

DETAILED DESCRIPTION OF PREFERRED EMBODIMENTS

Figure 1:
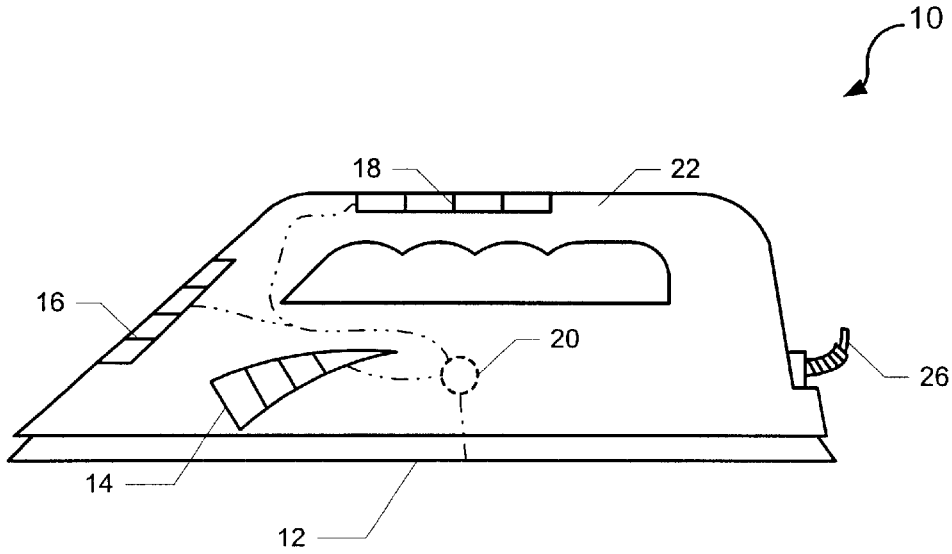
FIG. 1 is a simplified side view of a clothes iron.

Referring to FIG. 1, an iron 10 includes a heating surface 12, indicators 14, 16, 18, a thermistor 20, a handle portion 22, a grip 24, and a cord 26. The cord 26 provides an electrical conduit for energy to be conveyed to the iron 10 from an outlet. The heating surface 12 is configured to receive and distribute heat, preferably substantially uniformly, for application to clothes. The surface 12 is configured to be pressed against and run over clothes. The indicators 14, 16, 18 provide indicia of the temperature of the surface 12.

The indicators 14, 16, 18 are coupled to the surface 12 through the thermistor 20 and are responsive to an output signal from the thermistor 20. The thermistor 20 is configured to provide the output signal in accordance with a temperature of at least an area of the surface 12 to which the thermistor is connected. In response to the thermistor's output signal, the indicators can provide visual and/or audio indicia of the temperature.

Figure 2:
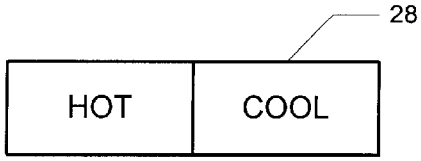
FIG. 2 is a schematic view of a temperature indicator.

Referring to FIGS. 2–7, the indicators 14, 16, 18 may be configured in a variety of forms to provide a variety of temperature indications. For example, an indicator 28 in FIG. 2 is essentially a binary indicator, signaling that the surface 12 is either "cool" or "hot." The "hot" indication may be provided by the indicator 14, 16, 18 when the temperature of the surface 12 is above a threshold temperature. This threshold temperature may be chosen, e.g., to be a temperature above which burns to skin are likely upon very brief contact, or may be below such a temperature by a safety factor to help ensure that injury is avoided. For example, the "hot" indication may be actuated whenever the temperature of the surface 12 exceeds room temperature or some other relatively-low temperature (relative to injury-inducing temperatures) such as 100° F.

Figure 3:
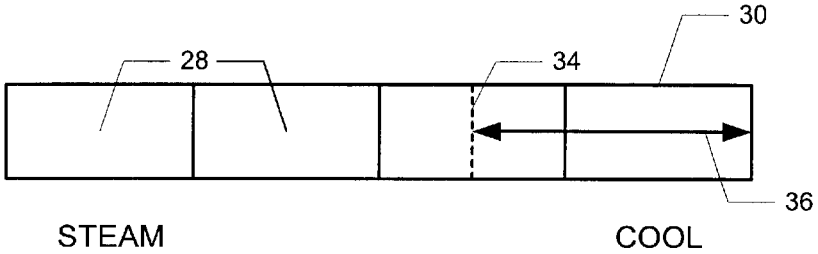
FIG. 3 is a schematic view of another temperature indicator with a segmented temperature indication.
Figure 4:
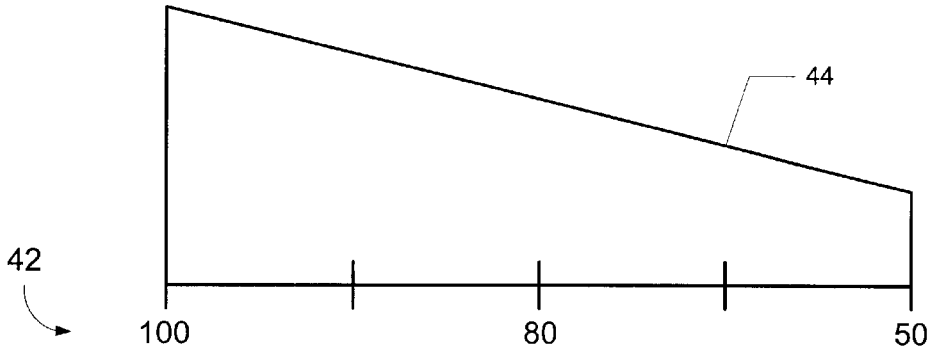
FIG. 4 is a schematic view of a temperature indicator similar to that shown in FIG. 3 with a continuous temperature indication.
Figure 5:
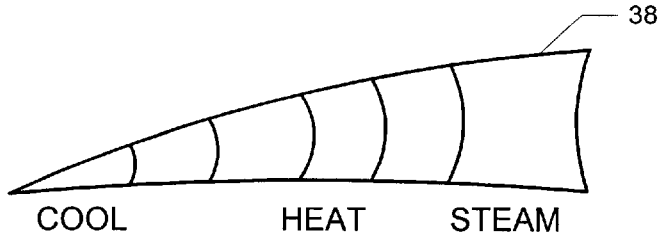
FIG. 5 is a schematic view of a temperature indicator similar to that shown in FIG. 4 with a different scale.

Referring to FIG. 3, a more detailed indication of temperature than a binary indication may be provided. An indicator 30 shown in FIG. 3 may provide multiple indications of temperature. The multiple indications may be in steps such that sections 32 of the indicator 30 change color as temperature thresholds of the surface 12 are exceeded, or as the temperature of the surface 12 falls below such thresholds. Alternatively, the indicator 30 may be analog such that the indicator 30 may start as a single color when cool and gradually change color, e.g., from right to left as shown, as the temperature of the surface 12 increases, and vice versa, as shown in FIG. 4. Thus, the indicator 30 provides a transitional point 34 that moves from right to left as the temperature of the surface 12 increases (and a corresponding bar 36 grows from right to left), and moves from left to right as the temperature of the surface 12 decreases (with the bar 36 shrinking).

Figure 6:
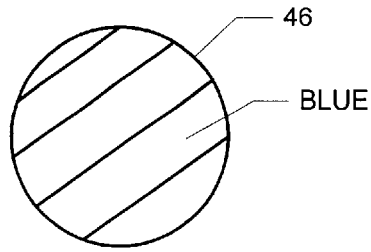
FIG. 6 is a simplified view of a thermochromatic temperature indicator in a "cool" mode.
Figure 7:
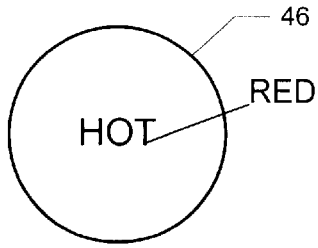
FIG. 7 is a simplified view of the thermochromatic temperature indicator shown in FIG. 6 in a "hot" mode.

As shown in FIGS. 2–5, the indicators 14, 16, 18, 28, 30, 38, 44 may indicate temperature in a variety of ways. The indicator 28 provides an indication of "hot" versus "cool" that may indicate safe and unsafe to touch. Scales 40, 42 provided with the indicators 30, 44 can be configured in accordance with temperatures relevant to the device, here a clothes iron, such as "cool and "steam" (scale 40), or may be configured to indicate actual temperatures according to a scale such as Fahrenheit or Celsius (scale 42). Similar to FIG. 2, an indicator 46 shown in FIGS. 6–7 provides indicia of cool versus hot, or safe versus unsafe to touch. In FIG. 6, the indicator 46 is a blue patch while in FIG. 7, the indicator 46 has changed appearance to read "HOT." The HOT indication is preferably in red. The indicator 46 is configured with the HOT indication covered by a thermochromatic material such as a paint that is blue when cool and transforms to be substantially transparent when heated. Alternatively, the thermochromatic material could transform from a first color, such as blue, to a second color, such as red, in response to receiving heat from the heating surface of the iron. The abruptness of the transition to transparency and the temperature, or temperature range, at/over which the transition occurs may be configured as desired.

Figure 8:
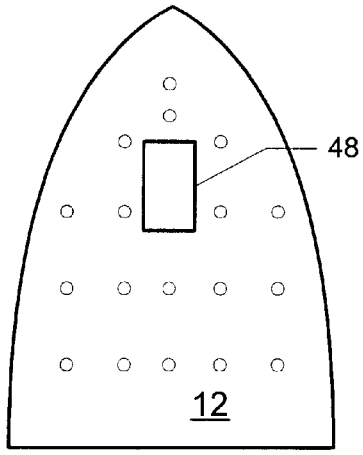
FIG. 8 is a simplified bottom view of the clothes iron shown in FIG. 1.

Referring to FIG. 8, an indicator 48 is provided on the bottom heating surface 12 of the iron 10. The indicator 48 is considered to be on the heating surface 12 even if the indicator does not provide heat (and even if not in exactly the same plane as other portions of the surface 12), the indicator being part of the same surface, with at least part of that surface providing heat. The indicator 48 may be of a variety of types such as those shown in FIGS. 2–7, and is preferably of the type shown in FIG. 2 or the type shown in FIGS. 6–7, or similar type. Thus, the indicator 48 provides a visual indication of whether the surface 12 is hot, unsafe, or cool, safe to touch. The indicator 48 may be larger relative to the bottom than as shown, such that the indicator 48 is disposed about a significant portion of the surface 12, and possibly substantially all of the surface 12 to help provide a prominent message regarding whether a person should avoid contact with the surface 12. If the indicator 48 comprises a thermochromatic material, this material may be configured to contact clothes.

Figure 9:
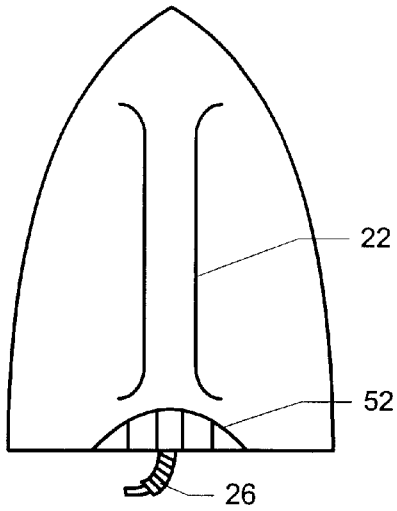
FIG. 9 is a simplified top view of another clothes iron.

Referring to FIG. 9, additional temperature indicators may be provided. For example, an indicator 52 may be provided near a rear of the iron 10.

In operation, referring to FIGS. 1–9, a process for indicating temperature of the system 10 includes various stages. The process, however, is exemplary only and not limiting. The process can be altered, e.g., by having stages added, removed, or rearranged. A user grabs the handle 22 including the grip 24. The user actuates the iron 10 to heat up. As the iron 10 heats up, the indicators 14, 16, 18, 48, 52 change as appropriate in accordance with the temperature of the surface 12. The changes may be abrupt or gradual in accordance with the particular indicator 14, 16, 18, 28, 30, 38, 44, 46, 48, 52. The user uses the iron 10 to iron desired items such as clothes. The user can operate a temperature selector to change the temperature of the surface 12. The indicators 14, 16, 18, 28, 30, 38, 44, 46, 48, 52 alter their indications as appropriate, e.g., "cool" indications changing to "hot," the transition point 34 of the indicator 30 moving to the left, or sections 32 changing color to their "hot" colors from their original colors. The user operates the iron such that the surface 12 will cool, such as by operating the temperature selector, and/or an on/off selector, or by unplugging the cord 26. The indicators 14, 16, 18, 28, 30, 38, 44, 46, 48, 52, adjust according to the cooling of the surface 12, e.g., "hot" indications changing to "cool," the transition point 34 of the indicator 30 moving to the right, or sections 32 changing color to their original colors.

Other embodiments are within the scope and spirit of the appended claims. For example, the indicators 14, 16, 18, 28, 30, 38, 44, 46, 48, 52, may be similar to each other or may be different from one or more of the other indicators 14, 16, 18, 28, 30, 38, 44, 46, 48, 52. For example, the indicator 48 on the bottom of the iron 10 may be of the type shown in FIGS. 6–7, while the indicators 14, 16, 18 may be of the type shown in FIGS. 34.

What is claimed is:

1. A clothes iron comprising:

a heat-sensitive element configured and disposed to receive heat from a heating surface of the clothes iron; and a visual indicator coupled to the heat-sensitive element and configured to provide a visual indication of heat received by the heat-sensitive element indicative of whether the heating surface is safe to touch.

2. The clothes iron of claim 1 wherein the heat-sensitive element and the visual indicator comprise a thermochromatic material.

3. The clothes iron of claim 2 wherein the thermochromatic material is configured to reflect light differently in response to receiving heat from the heating surface of the clothes iron.

4. The clothes iron of claim 3 wherein the thermochromatic material is configured to be substantially opaque at room temperature and substantially transparent in response to receiving heat from the heating surface, the visual indicator further comprising an image disposed beneath the thermochromatic material such that the image is substantially obscured when the thermochromatic material is substantially opaque and is substantially visible through the thermochromatic material when the thermochromatic material is substantially transparent.

5. The clothes iron of claim 1 wherein the visual indicator is disposed on at least one of the heating surface of the clothes iron, a side surface of the clothes iron, and a top surface of the clothes iron.

6. The clothes iron of claim 1 wherein the visual indicator provides a substantially binary indication of temperature of the heating surface.

7. The clothes iron of claim 1 wherein the visual indicator provides indicia of at least three amounts of temperature of the heating surface.

8. The clothes iron of claim 1 wherein the visual indicator is configured to indicate whether a temperature of the heating surface exceeds a threshold temperature, the threshold temperature being equal to a burn temperature reduced by a safety factor, the burn temperature being a temperature above which burns to skin are likely upon brief contact.

9. A clothes iron comprising:

a grip portion configured to be grasped by a person;

a heating surface coupled to the grip portion and configured to provide heat; and a heat-indicative apparatus coupled to the heating surface and configured to provide a visual indication of a temperature of the heating surface;

wherein the heat-indicative apparatus comprises a thermochromatic material.

10. The iron of claim 9 wherein the thermochromatic material is configured to reflect light differently in response to receiving heat from the heating surface of the clothes iron.

11. The iron of claim 10 wherein the thermochromatic material is configured to be substantially opaque at room temperature and substantially transparent in response to receiving heat from the heating surface, the visual indicator further comprising an image disposed beneath the thermochromatic material such that the image is substantially obscured when the thermochromatic material is substantially opaque and is substantially visible through the thermochromatic material when the thermochromatic material is substantially transparent.

12. The iron of claim 10 wherein the thermochromatic material is configured to be different colors when at approximately room temperature versus at a temperature above a predetermined threshold.

13. The iron of claim 9 wherein the heat-indicative apparatus comprises at least one visual indicator disposed on at least one of the heating surface of the clothes iron and a side surface of the clothes iron.

14. The iron of claim 9 wherein the heat-indicative apparatus comprises a visual indicator configured to provide a substantially binary indication of temperature of the heating surface.

15. The iron of claim 9 wherein the heat-indicative apparatus comprises a visual indicator configured to provide indicia of at least three amounts of temperature of the heating surface.

16. The iron of claim 9 wherein the indication of temperature is an indication of whether the heating surface is below a temperature at which the heating surface is considered to be safe to touch.

17. A clothes iron comprising:

a body including a handle, a base, and a heat-providing surface; and means for indicating a temperature of the heat-providing surface, the means including indicia of the heat-providing surface being at a first temperature considered to be safe to touch and of the heat-providing surface being at a second temperature considered to be unsafe to touch.

18. The clothes iron of claim 17 wherein the indicating means includes an indication of the heat-providing surface being at a third temperature that is different from the first and second temperatures.

19. A clothes iron comprising:

a grip portion configured to be grasped by a person;

a heating surface coupled to the grip portion and configured to provide heat and to contact clothes; and a heat-indicative apparatus coupled to the heating surface and configured to provide a visual indication of a temperature of the heating surface;

wherein the heat-indicative apparatus is disposed on the heating surface.

* * * * *